US010625390B2

(12) United States Patent
Takahashi et al.

(10) Patent No.: US 10,625,390 B2
(45) Date of Patent: Apr. 21, 2020

(54) POLISHING APPARATUS AND POLISHING METHOD

(71) Applicant: EBARA CORPORATION, Tokyo (JP)

(72) Inventors: Taro Takahashi, Tokyo (JP); Akihiko Ogawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 159 days.

(21) Appl. No.: 15/816,061

(22) Filed: Nov. 17, 2017

(65) Prior Publication Data

US 2018/0147687 A1 May 31, 2018

(30) Foreign Application Priority Data

Nov. 25, 2016 (JP) ..... 2016-228840

(51) Int. Cl.
*B24B 37/013* (2012.01)
*B24B 37/20* (2012.01)

(52) U.S. Cl.
CPC ..... *B24B 37/013* (2013.01); *B24B 37/20* (2013.01)

(58) Field of Classification Search
CPC ..... B24B 49/10; B24B 37/20; B24B 37/005; B24B 37/013
USPC ..... 451/5, 8, 9, 10, 287–289, 41
See application file for complete search history.

(56) References Cited

U.S. PATENT DOCUMENTS

2004/0119468 A1* 6/2004 Gotkis ..... H01L 22/26 324/230
2007/0239309 A1* 10/2007 Tada ..... B24B 37/005 700/121
2009/0149115 A1* 6/2009 Palou-Rivera ..... B24B 37/042 451/5

FOREIGN PATENT DOCUMENTS

JP 2015-076449 A 4/2015

* cited by examiner

*Primary Examiner* — Robert A Rose
(74) *Attorney, Agent, or Firm* — Abelman, Frayne & Schwab

(57) ABSTRACT

A polishing apparatus of the present disclosure polishes a polishing target by pressing the polishing target against a polishing pad. An eddy current sensor measures an impedance that is changeable according to a change of a film thickness of the polishing target, at a plurality of positions of the polishing target, and outputs measurement signals. A difference calculator generates data corresponding to a film thickness based on a measurement signal. The difference calculator calculates a difference between data at different times based on measurement signals output by the eddy current sensor at different times at a center of the polishing target. An end point detector detects a polishing end point indicating the end of polishing based on the difference calculated by the difference calculator.

14 Claims, 5 Drawing Sheets

POLISHING APPARATUS AND POLISHING METHOD

CROSS-REFERENCE TO RELATED APPLICATIONS

This application is based on and claims priority from Japanese Patent Application No. 2016-228840, filed on Nov. 25, 2016, with the Japan Patent Office, the disclosure of which is incorporated herein in its entirety by reference.

TECHNICAL FIELD

The present disclosure relates to a polishing apparatus and a polishing method, and particularly to detection of an end point of polishing.

BACKGROUND

Recently, as the integration and the density of a semiconductor device becomes higher, the wiring of a circuit gets increasingly miniaturized, and the number of layers in a multi-layer wiring also increases. In order to implement the multi-layer wiring while miniaturizing the circuit, it is required to precisely flatten the surface of the semiconductor device.

As a technology of flattening the surface of a semiconductor device, a chemical mechanical polishing (CMP) has been known. A polishing apparatus configured to perform the CMP includes a polishing table to which a polishing pad is attached, and a top ring configured to hold a polishing target (e.g., a substrate such as a semiconductor wafer, or various films such as a metal film or a barrier film formed on the surface of the substrate). The polishing apparatus supplies an polishing abrasive liquid (slurry) to the polishing pad, and presses the polishing target held by the top ring against the polishing pad while rotating the polishing table so that the polishing target is polished.

In the polishing apparatus, a polishing end point is generally determined in order to polish the polishing target to a desired thickness. For example, in the related art, a thickness detection of a conductive film is performed using an eddy current-type film thickness sensor. However, it is difficult to immediately terminate a polishing process at a point in time when a target thickness is reached. This is because a detection delay time occurs when a film thickness is detected, and it takes a certain period of time to stop polishing of a conductive film in actuality. Therefore, in a polishing process known in the related art, a polishing speed is calculated, and a temporary end point film thickness obtained by adding a predetermined offset value to a target thickness at which stopping the polishing is desired in actuality is calculated from the polishing speed. After the temporary end point film thickness is detected, the conductive film is polished for a predetermined polishing time. See, for example, Japanese Patent Laid-Open Publication No. 2015-076449.

SUMMARY

In order solve the problems, in a first aspect, there is provided a polishing apparatus that performs polishing of a polishing target by pressing the polishing target against the polishing pad supported on a polishing table so as to polish the polishing target while rotating the polishing table. The polishing apparatus includes: a sensor configured to measure a physical quantity that is changeable according to a change of a film thickness on the polishing target and to output measurement signals; a difference calculator configured to generate data corresponding to a film thickness based on the measurement signal, and to calculate a difference between the data obtained at different times based on the measurement signals output by the sensor at the different times at a predetermined position of the polishing target; and an end point detector configured to detect a polishing end point indicating an end of polishing based on the difference calculated by the difference calculator.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
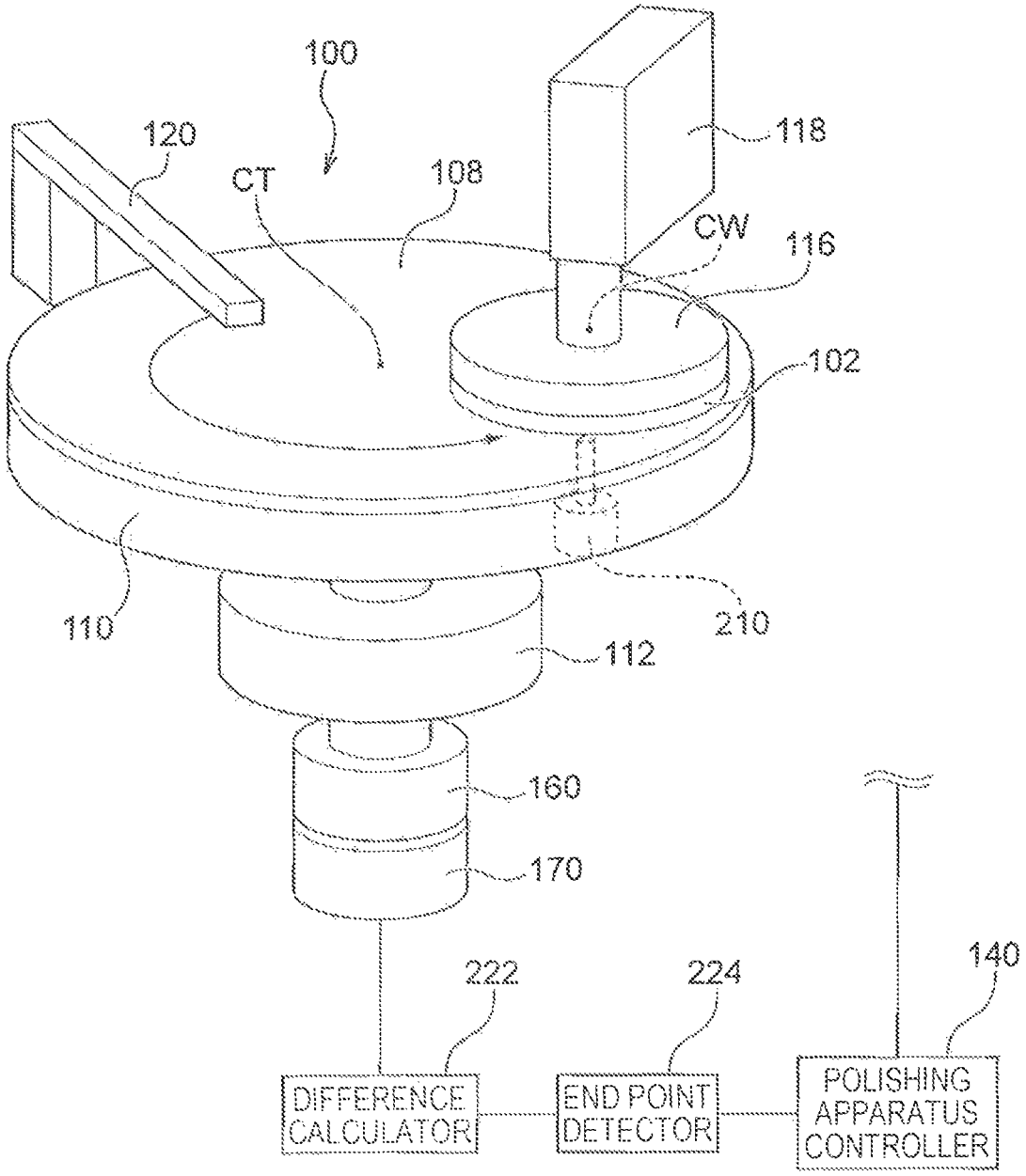
FIG. 1 is a view schematically illustrating the entire configuration of a polishing apparatus.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

In the related art, the measurement accuracy of a progress status in a polishing process has been insufficient in some cases. For example, in a method of calculating a temporary end point film thickness from a polishing speed, the accuracy is insufficient when it is desired to exactly remove only a metal film. That is, in the related art, a detection delay time occurs when a film thickness is detected, and due to the insufficient accuracy caused by the detection delay time, a problem occurs when it is desired to completely remove a metal film. When the removal of the metal film is insufficient, for example, an electrical short-circuit occurs. When an excessive polishing is performed to prevent short-circuiting, an insulating film existing under the metal film is excessively polished. An exemplary embodiment of the present disclosure has been made to solve such a problem, and to the present disclosure provides a polishing apparatus and a polishing method in which the measurement accuracy of a progress status in a polishing process is improved.

In order solve the problems, in a first aspect, there is provided a polishing apparatus that performs polishing of a polishing target by pressing the polishing target against the polishing pad supported on a polishing table so as to polish the polishing target while rotating the polishing table. The polishing apparatus includes: a sensor configured to measure a physical quantity that is changeable according to a change of a film thickness on the polishing target and to output measurement signals; a difference calculator configured to generate data corresponding to a film thickness based on the measurement signal, and to calculate a difference between the data obtained at different times based on the measurement signals output by the sensor at the different times at a predetermined position of the polishing target; and an end point detector configured to detect a polishing end point indicating an end of polishing based on the difference calculated by the difference calculator.

One of causes of occurrence of a detection delay time when a film thickness is detected has conventionally been that a moving average is performed on measurement signals output by a sensor over time. The moving average is performed over time in order to reduce the influence of an abnormal value when the abnormal value occurs in the measurement signals output by the sensor. In the present exemplary embodiment, the difference calculator does not perform a moving average on the measurement signals output by the sensor, over time. The difference calculator calculates a difference of the measurement signals output by the sensor at different times at a predetermined position of the polishing target. Therefore, when a film thickness is detected, a detection delay time caused by the moving average does not occur. It is possible to provide a polishing apparatus in which the measurement accuracy of a progress status in a polishing process is improved.

In a second aspect, the predetermined position is a center of the polishing target. In a third aspect, the predetermined position is a vicinity of a center of the polishing target. A variation of a film thickness is small at the center of the polishing target and the vicinity thereof as compared to at the peripheral portion of the polishing target. Thus, it is possible to precisely measure a film thickness. The vicinity of the center of the polishing target refers to, for example, (1) a range in which a polishing profile is stabilized or (2) a range is averaged as a whole within a spot diameter of the sensor. The range in which the polishing profile is stabilized indicates a range that is considered to be substantially flat without an unevenness occurring on a polished surface during polishing. This range depends on polishing conditions (that is, a material of a polishing target, a polishing time, a pressure distribution during polishing, etc.). The range averaged as a whole within a spot diameter of the sensor indicates a range in which an average polishing state is detected because an unevenness of a polished surface is not detectable in a range smaller than a certain size due to restrictions by a spot diameter of the sensor.

In a fourth aspect, the different times are different from each other by a time required for one rotation or a plurality of rotations of the polishing table. In the case where the different times are different from each other by a time required for one rotation or a plurality of rotations of the polishing table, the same position of a polishing target may be measured. When the measurements are made at the same position of the polishing target, there is no variation in a film thickness according to a difference in a position. Thus, it is possible to precisely measure a film thickness.

In a fifth aspect, the polishing apparatus includes a plurality of sensors. In this case, a plurality of measurements may be made at a predetermined position of the polishing target while the polishing table makes one rotation. Thus, a difference between the different times may be set to a time shorter than a time required for one rotation of the polishing table.

In a sixth aspect, the predetermined position includes a plurality of different positions. In a seventh aspect, the end point detector averages a plurality of differences calculated by the difference calculator to detect the polishing end point.

In an eighth aspect, there is provided a method of polishing a polishing target, including: performing polishing of the polishing target by pressing the polishing target against a polishing pad configured to polish the polishing target while rotating a polishing table that supports the polishing pad; measuring a physical quantity that is changeable according to a change of a film thickness of the polishing target, and outputting measurement signals; generating data corresponding to a film thickness based on the measurement signals, and calculating a difference between the data obtained at different times based on the measurement signals output at the different times at a predetermined position of the polishing target; and detecting a polishing end point indicating an end of polishing based on the calculated difference.

Hereinafter, exemplary embodiments of the present disclosure will be described with reference to drawings. In respective following exemplary embodiments, the same or corresponding members are denoted by the same reference numerals and duplicate explanations thereof will be omitted.

As illustrated in FIG. 1, a polishing apparatus 100 includes a polishing table 110 having a top surface on which a polishing pad 108 is attachable in order to polish a polishing target (for example, a substrate such as a semiconductor wafer, or various films such as a metal film or a barrier metal formed on the surface of the substrate) 102, a first electric motor 112 configured to rotatably drive the polishing table 110, a top ring 116 configured to hold the polishing target 102, and a second electric motor 118 configured to rotatably drive the top ring 116.

The polishing apparatus 100 includes a slurry line 120 configured to supply a polishing abrasive liquid containing abrasive grains (abrasive) to the top surface of the polishing pad 108. The polishing apparatus 100 polishes the polishing target 102 by pressing the polishing target 102 against the polishing pad 108 while rotating the polishing table 110 configured to support the polishing pad 108 that polishes the polishing target 102. The polishing apparatus 100 includes a polishing apparatus controller 140 that outputs various control signals on the polishing apparatus 100.

When polishing the polishing target 102, the polishing apparatus 100 supplies the polishing abrasive liquid containing abrasive grains from the slurry line 120 to the top surface of the polishing pad 108, and rotatably drives the polishing table 110 by the first electric motor 112. Then, the polishing apparatus 100 presses the polishing target 102 held by the top ring 116 against the polishing pad 108 while rotating the top ring 116 around a rotation axis eccentric with respect to a rotation axis of the polishing table 110. Accordingly, the polishing target 102 is polished and flattened by the polishing pad 108 that holds the polishing abrasive liquid.

As illustrated in FIG. 1, the polishing apparatus 100 includes an eddy current sensor 210 as a sensor, a difference calculator 222, and an end point detector 224 connected to the eddy current sensor 210 through rotary joint connectors 160 and 170. The eddy current sensor 210 measures a physical quantity that is changeable according to a change of a film thickness of a polishing target, at a plurality of positions of the polishing target, and outputs measurement signals. In the present exemplary embodiment, the physical quantity corresponds to a resistance and a self-inductance of the polishing target 102. In the present exemplary embodiment, an example in which the eddy current sensor 210 is used is described, but the present disclosure is not limited thereto. An optical sensor using a reflection of light may be used.

The difference calculator 222 generates data corresponding to a film thickness based on a measurement signal at the center (a predetermined position) of the polishing target 102. The difference calculator 222 calculates a difference between data at different times based on measurement signals output by the eddy current sensor 210 at different times at a predetermined position of the polishing target 102 as measurement signals. In the present exemplary embodiment, the difference calculator 222 does not perform a moving average as described below on the measurement signals. The end point detector 224 detects a polishing end point indicating the end of polishing, based on the difference calculated by the difference calculator 222. The predetermined position is the center of the polishing target 102 in the present exemplary embodiment.

The predetermined position is not limited to the center of the polishing target 102, but may be the vicinity of the center of the polishing target 102. The predetermined position is not limited to one position, but may include a plurality of positions. When the predetermined position includes the plurality of positions, the end point detector 224 detects a polishing end point by averaging a plurality of differences calculated by the difference calculator 222. Otherwise, the difference calculator 222 may average measurement signals output from the eddy current sensor 210, and then obtain a difference between average values. The end point detector 224 detects a polishing end point based on the difference calculated by the difference calculator 222. In the present exemplary embodiment, the different times are different from each other by a time required for one rotation of the polishing table 110. The different times may be different from each other by a time required for a plurality of rotations of the polishing table 110.

First, the eddy current sensor 210 will be described. A hole is formed in the polishing table 110. into which the eddy current sensor 210 may be inserted from the rear surface side of the polishing table 110. The eddy current sensor 210 is inserted into the hole formed in the polishing table 110.

The eddy current sensor 210 is provided at a location passing through the center CW of the polishing target 102 that is being polished and held by the top ring 116. The reference symbol CT indicates the rotation center of the polishing table 110.

The polishing target 102 rotates around the center CW as an axis. Meanwhile, according to the rotation of the polishing table 110, the eddy current sensor 210 rotates around the center CT as the rotation center. As a result, a polishing process of polishing the polishing target 102 includes a first status in which the eddy current sensor 210 does not pass through a portion below the polishing target 102 and does not face the polishing target 102. The polishing process includes a second status in winch the eddy current sensor 210 passes through a portion below the polishing target 102 and faces the polishing target 102. The first status and the second status alternately appear according to the rotation of the polishing table 110.

The polishing abrasive liquid is supplied to the top of the polishing pad 108, and moves toward the outside of the polishing pad 108 by being subject to a centrifugal force due to the rotation of the polishing table 110, and rotates according to the rotation of the polishing table 110.

Figure 2A:
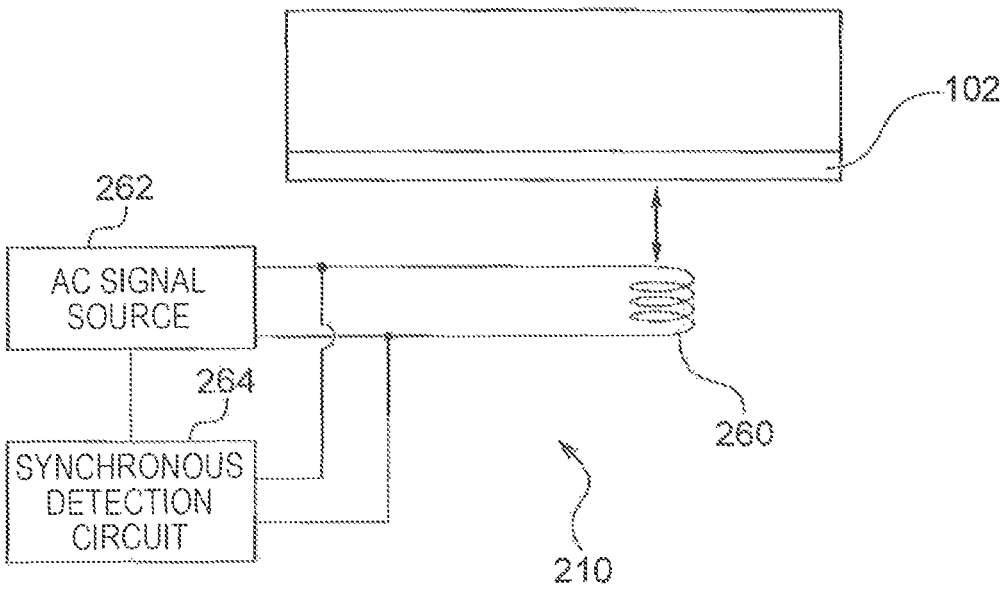
FIGS. 2A and 2B are views illustrating the configuration of an eddy current sensor.
Figure 2B:
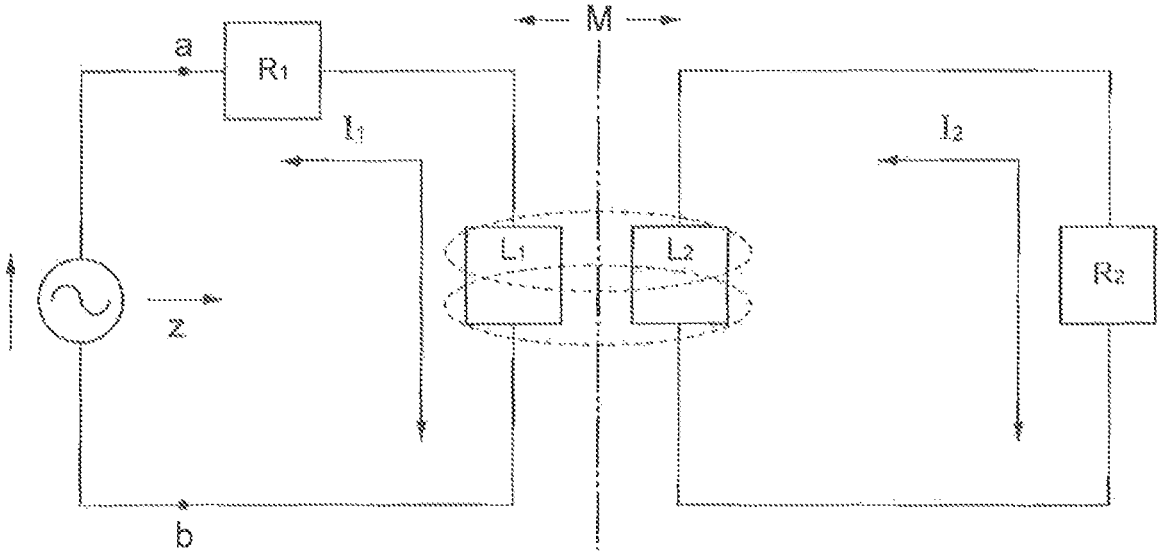

FIGS. 2A and 2B are views illustrating the configuration of the eddy current sensor 210. FIG. 2A is a block diagram illustrating the configuration of the eddy current sensor 210, and FIG. 2B is an equivalent circuit diagram of the eddy current sensor 210.

As illustrated in FIGS. 2A and 2B, the eddy current sensor 210 includes a sensor coil 260 disposed in the vicinity of the polishing target 102 as a detection target such as a metal film. An AC signal source 262 is connected to the sensor coil 260. Here, the polishing target 102 as a detection target is, for example, a thin film made of Cu, Al, Au, W, etc. formed on a semiconductor wafer. The sensor coil 260 is disposed in the vicinity of the polishing target 102 as the detection target (e.g., about 0.5 mm to 5.0 mm from the polishing target 102).

There is a frequency type-eddy current sensor 210 in which a conductive film is detected based on a change in the oscillation frequency of the AC signal source 262, which is caused by the generation of an eddy current in the polishing target 102. There is an impedance type-eddy current sensor 210 in which a conductive film is detected based on a change in the impedance as viewed from the AC signal source 262 caused by the generation of an eddy current in the polishing target 102. That is, in the frequency type, to the equivalent circuit illustrated in FIG. 2B, the eddy current $I_2$ is changed, and then, the impedance Z is changed. As a result, the oscillation frequency of the AC signal source (variable frequency oscillator) 262 is changed. The eddy current sensor 210 may detect a change of the oscillation frequency by a detection circuit 264, and detect a change of the conductive film. In the impedance-type, in the equivalent circuit illustrated in FIG. 2B, the eddy current $I_2$ is changed, and then, the impedance Z is changed. As a result, the impedance Z viewed from the AC signal source (fixed frequency oscillator) 262 is changed. The eddy current sensor 210 may detect a change of the impedance Z by the detection circuit 264 and detect a change of the conductive film.

In the impedance-type eddy current sensor, signal outputs X and Y which are a real part and an imaginary part of the impedance Z, the phase of the impedance Z and the absolute value of the impedance Z are extracted. Measurement information of the conductive film may be obtained from a frequency F, or signal outputs X and Y, etc. The eddy current sensor 210 may be embedded at a location in the vicinity of the surface within the polishing table 110 as illustrated in FIG. 1. The eddy current sensor 210 may detect a change of the conductive film from an eddy current flowing through the polishing target 102 while being located to face the polishing target 102 through the polishing pad.

Hereinafter, the impedance-type eddy current sensor will be specifically described. The AC signal source 262 is an oscillator with a fixed frequency of about 1 MHz to 50 MHz, and, for example, a crystal oscillator is used. Then, a current $I_1$ flows through the sensor coil 260 by an AC voltage supplied by the AC signal source 262. When a current flows through the sensor coil 260 disposed in the vicinity of the polishing target 102, a magnetic flux generated from the sensor cod 260 interlinks with the polishing target 102. As a result, a mutual inductance M is formed between the sensor coil 260 and the polishing target 102, and an eddy current $I_2$ flows through the polishing target 102. Here, $R_1$ indicates a resistance at a primary side including the sensor coil 260, and $L_1$ indicates a self-inductance at the primary side including the sensor coil 260 likewise. At the polishing target 102 side, $R_2$ indicates a resistance corresponding to an eddy current loss, and $L_2$ indicates a sell-inductance of the polishing target 102. The impedance Z when the sensor coil 260 side is viewed from terminals a and b of the AC signal source 262 is changed due to the influence of the line of magnetic force generated by the eddy current $I_2$.

Figure 3:
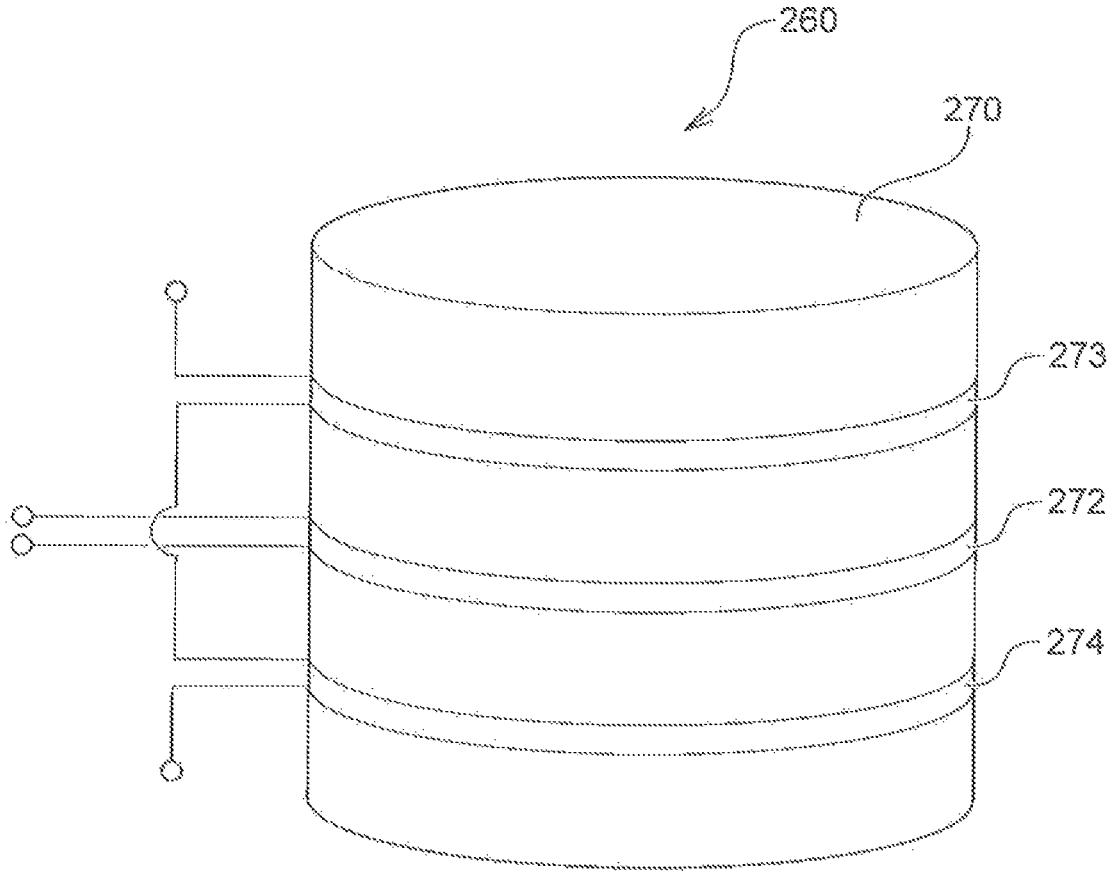
FIG. 3 is a schematic view illustrating a configuration example of a sensor coil used in the eddy current sensor.

FIG. 3 is a schematic view illustrating the configuration example of a sensor coil used in an eddy current sensor. As illustrated in FIG. 3, the sensor coil 260 of the eddy current sensor includes three coils 272, 273, and 274 wound around a bobbin 270. The coil 272 is an excitation coil connected to the AC signal source 262. The excitation coil 272 is excited by an alternating current supplied irons the AC signal source 262, and forms an eddy current in the polishing target 102 disposed in the vicinity thereof. A detection coil 273 is disposed at the polishing target 102 side of the bobbin 270, and detects a magnetic field generated by an eddy current formed in the polishing target 102. A balance coil 274 is disposed on the opposite side of the detection coil 273 across the excitation coil 272.

When the polishing target 102 is present in the vicinity of the detection coil 273, a magnetic flux generated by the eddy current formed in the polishing target 102 interlinks with the detection coil 273 and the balance coil 274. Here, since the detection coil 273 is disposed at a position closer to the conductive film, the balance of the induced voltages generated in both cods 273 and 374 is lost, and accordingly, the interlinked magnetic flux formed by the eddy current of the conductive film may be detected.

Figure 4A:
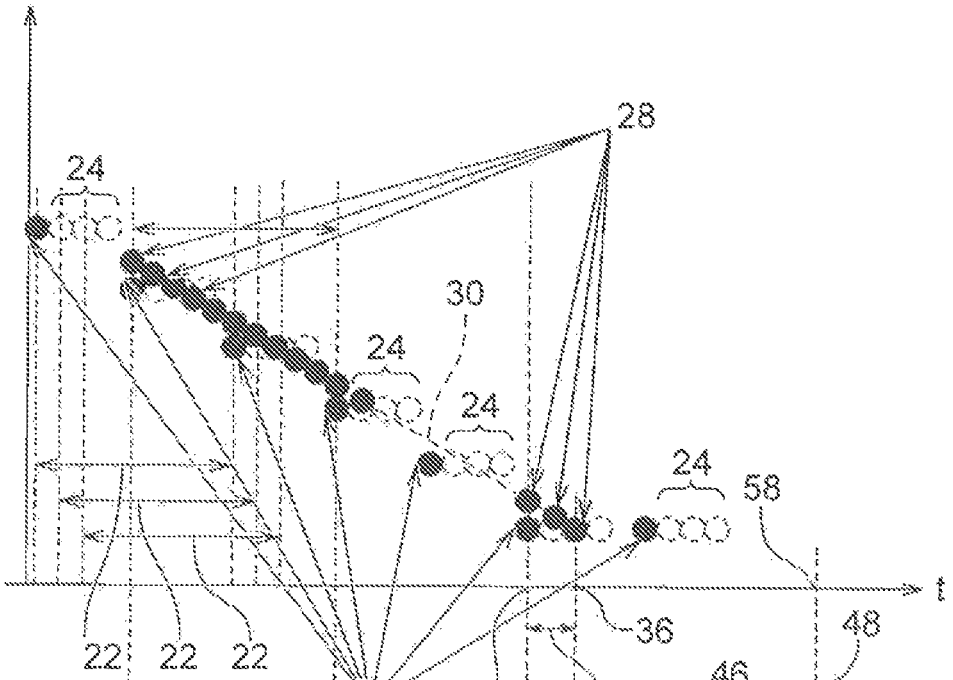
FIGS. 4A and 4B are explanatory views of an output in a comparative example to be compared to an exemplary embodiment of the present disclosure.
Figure 4B:
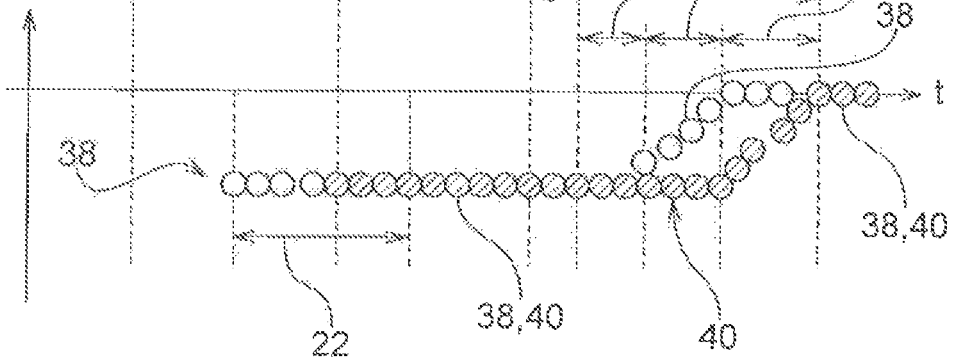

Hereinafter, the detection of the polishing end point will be described with reference to FIGS. 4A and 4B, and FIGS. 5A and 5B. FIGS. 4A and 4B are views illustrating a comparative example to be compared to the present exemplary embodiment. In FIG. 4A, the horizontal axis indicates a time, and the vertical axis indicates, for example, an absolute value 20 of the impedance corresponding to a film thickness, which is obtained from a measurement signal output by the eddy current sensor 210. In FIG. 4B, the horizontal axis indicates a time, and the vertical axis indicates a value obtained by subtracting the absolute value of the impedance corresponding to the film thickness, which is obtained from the measurement signal output by the eddy current sensor 210. In the comparative example, the moving average of the absolute values 20 of the impedance is performed over a period 22 in which the polishing table 110 makes two rotations.

During a period in which the polishing table 110 makes one rotation, a first status and a second status are present as described above. In the first status, there is no measurement signal on the polishing target, which is output from the eddy current sensor 210, while only in the second status, a measurement signal on the polishing target is output from the eddy current sensor 210. When the moving average is obtained, dummy data 24 is used as interpolation data in the first status. The dummy data 24 is, for example, an average value of the absolute values 20 in the second status present immediately prior to the dummy data 24. Therefore, in the present comparative example, the dummy data 24 is a constant value in the first status during a period in which the polishing table 110 makes one rotation, that is, during one rotation.

In the second status, the eddy current sensor 210 outputs a plurality of measurement signals, for example, 100 measurement signals. During the period in which the polishing table 110 makes one rotation, the length of the period of the first status is about several times to 10 times the length of the period of the second status. In FIGS. 4A and 4B, the plurality of absolute values 20 in the second status is indicated by one black circle for the purpose of clarification, but, in actuality, correspond to a set of 100 absolute values 20. The dummy data 24 in the first status is indicated by three dotted circles for the purpose of clarification, but in actuality, correspond to a set of hundreds or more pieces of dummy data 24.

When the moving average is obtained, the absolute values 20 and the dummy data 24 are averaged over the period 22. The period 22 is a period in which the polishing table 110 makes two rotations. The periods 22 have the same length in FIGS. 4A and 4B, but do not necessarily need to have the same length. The moving average is performed using the absolute values 20 and the dummy data 24 of the length of the period 22, ahead of the time when the measurement by the eddy current sensor 210 is performed. Therefore, within the period 22, two black circles, and six dotted circles are illustrated. As illustrated in FIG. 4A, an average is calculated by gradually shifting the period 22. In the case of the comparative example in FIGS. 4A and 4B, the obtained average values 28 are present on a straight line 30 descending to the right until reaching the polishing end point.

In the process of obtaining a moving average, a delay time 32 occurs between a time when a measurement is performed by the eddy current sensor 210 and a time when a moving average may be obtained. The illustrated delay time 32 is a difference between a time 34 when a metal film is completely removed, and a time 36 when a process of obtaining the moving average is completed using the absolute value 20 measured at the time 34.

FIG. 4B illustrates difference values 38 obtained by subtracting the average values 28 obtained from the measurement signals output by the eddy current sensor 210, and average values 40 obtained by performing the moving average on the difference values 38. A difference value 38 is a difference between an average value 28 at a certain point in time and an average value 28 ahead of the point in time by a period in which the polishing table 110 makes one rotation. The average values 40 are calculated by performing a moving average on the difference values 38 over a period having the same length as that of the period 22 in which the average values 28 are obtained.

In the case of the comparative example, the following detection delay time occurs due to these processings. Here, the detection delay time is a difference between a time 34, which is an actual polishing end point time, and a time 58 when an average value 40 of differences may be obtained and thus, the polishing end point is detected. The detection delay time includes a delay time 32 caused by the moving average processing of obtaining the average value 28, a delay time 42 caused by a difference processing of obtaining the difference value 38, a delay time 46 caused by the fact that a difference is a difference for a period of one rotation of the polishing table 110, and a delay time 44 caused by the moving average processing of obtaining the average value 40. The detection delay time 48, which is the sum of these times, corresponds to a period in which the polishing table 110 makes three rotations in the case of the comparative example.

In the case of the comparative example, the dummy data 24 is used is because the output data of the eddy current sensor 210 obtained when the polishing table 110 makes one rotation is small (that is, the length of the period of the first status is about several times to 10 times the length of the period of the second status). Further, the dummy data 24 is used in order to make a correction when an abnormal value occurs In the output data. As described above, when the average values 28 and the average values 40 are obtained, the moving average is performed by inserting the dummy data 24 during one rotation of the polishing table 110 so that the influence of the abnormal value is reduced.

In the case of the comparative example, a residual film amount may be detected by the average values 28. Depending on whether or not the average value 40 considered as a differential value is "0," it is possible to detect whether the metal film has been completely removed, that is, whether the metal has been cleared.

In the case where there is a low possibility that an abnormal value occurs in the output data, due to an improvement of a sensor performance, a stability of a process during polishing, or the like, or in the case where the influence of an abnormal value is small even when the abnormal value occurs in the output data, a delay time according to a moving average is not desirable. In the case of the comparative example, delay times occur at two calculation points, i.e. the delay time 32 caused by the moving average processing of obtaining the average value 28, and the delay time 44 caused by the moving average processing of obtaining the average value 40. Due to these delay times, an over-polishing (dishing, erosion, etc.) occurs, and thus it is desirable to shorten the delay times. Particularly, these delay times are not desirable in the clearing of metal in which a high accuracy is required for a thickness of a film remaining after polishing.

Figure 5A:
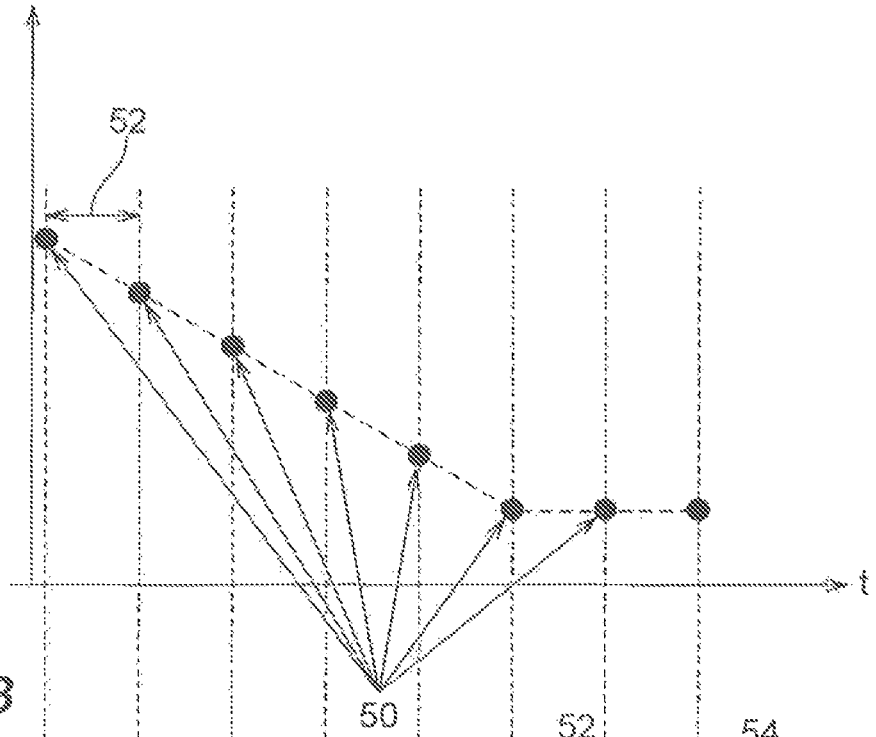
FIGS. 5A and 5B are explanatory views of an output in the exemplary embodiment of the present disclosure.
Figure 5B:
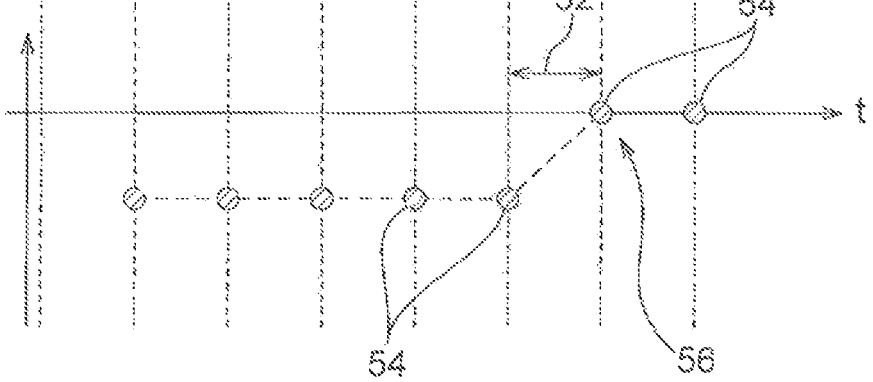

In an exemplary embodiment of the present disclosure as illustrated in FIGS. 5A and 5B, for a measurement value by the eddy current sensor 210, a comparison is made (a difference is obtained) between a measurement value at a certain point in time, and a measurement value ahead of the point in time, by one rotation of the polishing table 110. When the absolute value of the obtained difference becomes equal to or less than a constant value, the metal is cleared. Accordingly, it is possible to detect an end point without performing a moving average.

Without obtaining a difference, and without performing a moving average, it is possible to average data at a wafer central portion acquired for each rotation of the polishing table 110 (or to use only one point in the vicinity of the central portion) and to detect a polishing end point from the obtained data.

The exemplary embodiment illustrated in FIGS. 5A and 5B will be described below. In FIG. 5A, the horizontal axis indicates a time, and the vertical axis indicates an absolute value 50 of the impedance corresponding to a film thickness, which is obtained from a measurement signal output by the eddy current sensor 210. In FIG. 5B, the horizontal axis indicates a time, and the vertical axis indicates a difference value 54 obtained by subtracting the absolute value of the impedance corresponding to the film thickness, which is obtained from the measurement signal output by the eddy current sensor 210. In the present exemplary embodiment, a moving average is not performed. The clearing of metal is detected from data obtained using only the center data of the polishing target 102 acquired for each rotation of the polishing table 110, i.e. only the data obtained for one location of the polishing target 102.

The difference calculator 222 generates the absolute value 50 of the impedance corresponding to a film thickness, which is data corresponding to the film thickness, based on the measurement signal output by the eddy current sensor 210. The absolute value 50 is generated at each of different times as illustrated in FIG. 5A. The different times are different from each other by a time 52 required for one rotation of the polishing table 110. The difference calculator 222 calculates the difference value 54 between data at different times based on the measurement signals output by the eddy current sensor 210 at different times without performing a moving average on the absolute values 50. In the present exemplary embodiment, in contrast to the comparative example, the delay time 32 and the delay time 44 caused by the moving average do not occur. Thus, the detection accuracy of a polishing end point, such as the clearing of metal, is improved. In the present exemplary embodiment, a delay occurs for the time 52 required for one rotation of the polishing table 110 because the difference is a difference for a period of one rotation of the polishing table 110.

As a method of further reducing the time 52, there is a method of disposing a plurality of eddy current sensors 210 within the polishing table 110. The plurality of eddy current sensors 210 are disposed at locations passing through the center CW of the polishing target 102. For example, an eddy current sensor 210 is disposed at a location point-symmetric to the eddy current sensor 210 about the rotation center CT illustrated in FIG. 1. In this manner, in the case where two eddy current sensors 210 are disposed within the polishing table 110, when the polishing table 110 makes a half-rotation, the next measurement signal may be obtained. In the exemplary embodiment, the difference may be a difference corresponding to a half-rotation period of the polishing table 110. Therefore, the delay time caused by the fact that the difference is a difference corresponding to the half-rotation period of the polishing table 110 is reduced by half as compared to the time 52 illustrated in FIGS. 5A and 5B. When the delay time is reduced by half, the accuracy of end point detection is improved.

The end point detector 224 detects a difference value 56 corresponding to a polishing end point indicating the end of polishing, based on the difference value 54 calculated by the difference calculator 222. When detecting the polishing end point of the polishing target 102, the end point detector 224 outputs a signal indicating the detection to the polishing apparatus controller 140. When receiving a signal indicating the polishing end point from the end point detector 224, the polishing apparatus controller 140 ends the polishing by the polishing apparatus 100.

A film thickness of the polishing target 102 detected by a film thickness sensor or a signal corresponding to the film thickness may be sent to an upper-level host computer (a computer connected to a plurality of semiconductor manufacturing apparatuses so as to manage the semiconductor manufacturing apparatuses) and stored in the host computer. Then, according to the film thickness of the polishing target 102 or the signal corresponding to the film thickness, which is sent from the polishing apparatus side, the difference value 54 between data at different times may be calculated by the host computer. When the polishing end point of the polishing target 102 is detected based on the difference value 54, a signal indicating the detection may be sent to the controller 140 of the polishing apparatus.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A polishing apparatus comprising:

a polishing table that supports a polishing pad thereon so as to perform polishing of a polishing target by pressing the polishing target against the polishing pad supported on the polishing table while rotating the polishing table;

a sensor configured to measure a physical quantity that is changeable according to a change of a film thickness on the polishing target at a predetermined position of the polishing target and to output measurement signals;

a difference calculator configured to generate data corresponding to a film thickness based on the measurement signal, and to calculate a difference between the data obtained at different times based on the measurement signals output by the sensor at the different times when the polishing table is rotated; and an end point detector configured to detect a polishing end point indicating an end of polishing based on the difference calculated by the difference calculator.

2. The polishing apparatus of claim 1, wherein the predetermined position is a center of the polishing target.

3. The polishing apparatus of claim 1, wherein the predetermined position is a vicinity of a center of the polishing target.

4. The polishing apparatus of claim 1, wherein the different times are different from each other by a time required for one rotation or a plurality of rotations of the polishing table.

5. The polishing apparatus of claim 1, wherein the polishing apparatus includes a plurality of sensors.

6. The polishing apparatus of claim 1, wherein the predetermined position includes a plurality of different positions.

7. The polishing apparatus of claim 6, wherein the end point detector averages a plurality of differences calculated by the difference calculator to detect the polishing end point.

8. A method of polishing a polishing target, the method comprising:

performing polishing of the polishing target by pressing the polishing target against a polishing pad configured to polish the polishing target while rotating a polishing table that supports the polishing pad;

measuring a physical quantity that is changeable according to a change of a film thickness of the polishing target at a predetermined position of the polishing target, and outputting measurement signals;

generating data corresponding to a film thickness based on the measurement signals, and calculating a difference between the data obtained at different times based on the measurement signals output at the different times when the polishing table is rotated; and detecting a polishing end point indicating an end of polishing based on the calculated difference.

9. The polishing apparatus of claim 1, wherein the difference calculator is configured to calculate the difference without performing a moving average on the measurement signals output by the sensor.

10. The polishing apparatus of claim 1, wherein the sensor is configured to detect the film thickness based on a change in an oscillation frequency of an AC signal source, which is caused by generation of an eddy current in the polishing target.

11. The polishing apparatus of claim 1, wherein the sensor is configured to detect the film thickness based on a change in an impedance as viewed from an AC signal source caused by generation of an eddy current in the polishing target.

12. The polishing apparatus of claim 1, wherein the end point detector determines that the polishing is finished when an absolute value of the difference becomes equal to or less than a predetermine value.

13. The polishing apparatus of claim 1, wherein the sensor is disposed at a location that passes through a center of the polishing target.

14. The polishing apparatus of claim 1, further comprising:

a second sensor disposed at a location that is point-symmetric to the sensor about a rotation center of the polishing table.

* * * * *